US012434892B2

(12) United States Patent
Kuiper

(10) Patent No.: US 12,434,892 B2
(45) Date of Patent: Oct. 7, 2025

(54) BIODEGRADABLE AND COMPOSTABLE FOOD PACKAGING UNIT FROM A MOULDED PULP MATERIAL, AND METHOD FOR MANUFACTURING SUCH FOOD PACKAGING UNIT

(71) Applicant: HUHTAMAKI MOLDED FIBER TECHNOLOGY B.V., Franeker (NL)

(72) Inventor: Harald Kuiper, Heerenveen (NL)

(73) Assignee: HUHTAMAKI MOLDED FIBER TECHNOLOGY B.V., Franeker (NL)

( * ) Notice: Subject to any disclaimer, the term of this patent is extended or adjusted under 35 U.S.C. 154(b) by 1360 days.

(21) Appl. No.: 16/338,770

(22) PCT Filed: Oct. 3, 2017

(86) PCT No.: PCT/NL2017/050654
§ 371 (c)(1),
(2) Date: Apr. 2, 2019

(87) PCT Pub. No.: WO2018/067006
PCT Pub. Date: Apr. 12, 2018

(65) Prior Publication Data

US 2021/0163198 A1 Jun. 3, 2021

(30) Foreign Application Priority Data

Oct. 3, 2016 (NL) ..... 2017569
Apr. 28, 2017 (NL) ..... 2018806

(51) Int. Cl.
*B65D 65/46* (2006.01)
*B65D 65/42* (2006.01)
(Continued)

(52) U.S. Cl.
CPC ..... *B65D 65/466* (2013.01); *B65D 65/42* (2013.01); *B65D 85/324* (2013.01); *D21H 17/53* (2013.01);
(Continued)

(58) Field of Classification Search
CPC ..... B65D 65/466; B65D 65/42; B65D 85/324
See application file for complete search history.

(56) References Cited

U.S. PATENT DOCUMENTS 1,929,944 A * 10/1933 Chaplin ..... B65D 85/322 217/26.5
4,280,648 A * 7/1981 Boursier ..... B65D 85/324 206/520
(Continued)

FOREIGN PATENT DOCUMENTS

CA 2195815 A1 9/1997
CN 1515740 A * 7/2004
(Continued)

OTHER PUBLICATIONS

International Search Report and Written Opinion mailed Nov. 23, 2017 for PCT/NL2017/050654.

*Primary Examiner* — Steven A. Reynolds
*Assistant Examiner* — Prince Pal
(74) *Attorney, Agent, or Firm* — Dinsmore & Shohl LLP

(57) ABSTRACT

The present invention relates to a biodegradable food packaging unit from a moulded pulp material and a method for manufacturing such biodegradable packaging unit. The packaging according to the invention comprises a food receiving or carrying compartment, wherein the moulded pulp material comprises an amount of a biodegradable aliphatic polyester, wherein the food packaging unit is a compostable food packaging unit. In a preferred embodiment the amount of biodegradable aliphatic polyester is in
(Continued)

the range of 0.5-20 wt. %, more preferably in the range of 1-15 wt. %.

8 Claims, 6 Drawing Sheets

(51) Int. Cl.
*B65D 85/32* (2006.01)
*D21H 17/53* (2006.01)
*D21H 19/28* (2006.01)
*D21H 27/10* (2006.01)

(52) U.S. Cl.
CPC ..... *D21H 19/28* (2013.01); *D21H 27/10* (2013.01); *B65D 2501/24038* (2013.01); *B65D 2577/00* (2013.01)

(56) References Cited

U.S. PATENT DOCUMENTS 5,512,333 A * 4/1996 Suskind ..... D21H 19/00 241/DIG. 38
5,540,962 A * 7/1996 Suskind ..... B05D 3/00 206/812
5,964,933 A * 10/1999 Nakamura ..... C08L 97/02 106/217.7
8,991,604 B2 * 3/2015 Buckley ..... B65D 85/324 206/521.1
10,703,558 B2 * 7/2020 Dijkstra ..... B65D 85/324
2004/0045690 A1 * 3/2004 Eto ..... D21J 3/10 162/224
2004/0166758 A1 * 8/2004 Reichmann ..... D04H 3/16 442/361
2005/0171250 A1 * 8/2005 Hayes ..... C08L 67/02 524/445
2006/0108978 A1 * 5/2006 Kumakura ..... B65D 65/466 320/112
2007/0017845 A1 * 1/2007 Tietschert ..... B65D 85/324 206/521.1
2008/0044650 A1 * 2/2008 Sukigara ..... B32B 27/36 428/338
2010/0062670 A1 * 3/2010 Bastioli ..... C08L 67/02 524/427
2010/0181372 A1 7/2010 Huang
2010/0187150 A1 * 7/2010 Dijkstra ..... B65D 85/324 206/521.1
2010/0190020 A1 * 7/2010 Frederiksen ..... D04H 1/5412 162/146
2012/0097602 A1 * 4/2012 Tedford ..... B65D 65/466 210/500.1
2012/0189860 A1 * 7/2012 Li ..... B32B 27/08 525/445
2012/0270048 A1 * 10/2012 Saigusa ..... C08G 63/08 528/361
2013/0243912 A1 * 9/2013 Jensen ..... B65D 81/264 426/124
2014/0151258 A1 * 6/2014 Vadhar ..... B65D 23/0878 53/442
2020/0055663 A1 * 2/2020 Cardoso ..... C08B 30/00
2020/0131710 A1 * 4/2020 Kuiper ..... B65D 5/5083
2020/0216244 A1 * 7/2020 Pluquet ..... B29C 45/14811
2021/0164171 A1 * 6/2021 Kuiper ..... B65D 65/466

FOREIGN PATENT DOCUMENTS

JP 2005313520 A * 11/2005
WO 2013007872 A1 1/2013
WO 2014064340 A1 5/2014
WO 2015057061 A1 4/2015
WO 2016130006 A1 8/2016

* cited by examiner

BIODEGRADABLE AND COMPOSTABLE FOOD PACKAGING UNIT FROM A MOULDED PULP MATERIAL, AND METHOD FOR MANUFACTURING SUCH FOOD PACKAGING UNIT

The present invention relates to food packaging units from a moulded pulp material. Such food packaging unit may relate to cases, boxes, cups, plates, carriers, sip lids etc.

Packaging units that are made from a moulded pulp material are known. Such moulded pulp often originates from recycled paper material and/or virgin fibres. These packaging units are used to store, transport and/or display a range of product, including food products such as eggs, tomatoes, kiwi□s.

Packaging units that come into contact with food products are subject to many restrictions. This often requires providing an additional film layer on or in the packaging unit, with the film layer acting as a barrier. This barrier separates the food product from the moulded pulp material of the packaging unit.

One of the problems with such food packaging units comprising an additional film layer is that the packaging units are often not sustainable, or at least not fully sustainable. Furthermore, this use of an additional film layer also puts restrictions on the recycling possibilities.

The present invention has for its object to obviate or at least reduce the above stated problems in conventional food packaging units and to provide a food packaging unit that is more sustainable and/or has improved recycling possibilities.

For this purpose, the present invention provides a food packaging unit from a moulded pulp material, with the packaging unit comprising a food receiving or carrying compartment, and wherein the moulded pulp material comprises an amount of a biodegradable aliphatic polyester, wherein the food packaging unit is a compostable food packaging unit.

The food packaging unit according to the invention comprises a compartment capable of receiving or carrying a food product. For example, a food receiving compartment may relate to a compartment capable of holding a food product, such as eggs, tomatoes, kiwis, or a container for holding a beverage. A carrying compartment may relate to a carrier surface whereon or wherein a food product can be placed, such as a plate, bottle divider etc.

In the context of this invention degradable relates to degradation resulting in loss of properties, while biodegradable relates to degradation resulting from the action of microorganisms such as bacteria, fungi and algae. Compostable relates to degradation by biological process to yield $CO_2$, water, inorganic compounds and biomass.

The food packaging unit according to the invention is compostable thereby providing a sustainable packaging unit. This provides a biodegradable alternative material to plastics, for example. This improves recycling properties of the packaging units that are made from moulded pulp (including so-called virgin fiber material and/or recycled fiber material) and comprise a biodegradable aliphatic polyester.

A further advantage of adding an amount of biodegradable aliphatic polyester is that the packaging unit can also be decomposed using microorganisms in soil, for example. This enables decomposing the food packaging unit comprising an biodegradable aliphatic polyester as a whole. In such preferred embodiment, the food packaging unit can be decomposed at home, thereby rendering the food packaging unit home-compostable. Such home-compostable packaging unit further improves the overall sustainability of the packaging unit of the invention. This enables replacing the use of less sustainable materials, such as CPET, PP, PE, PS, aluminium in food packaging units.

The biodegradable aliphatic polyester can be mixed in the original moulded pulp material such that it is distributed over substantially the entire food packaging unit and/or can be provided as a separate layer on the side of the food packaging unit that may come into contact with a food product, for example.

A further advantage of the present invention is the improvement of barrier properties. Barrier properties may include oxygen and/or grease barriers. Also, the penetration of oil originating from the food product, such as pasta or French fries, into the food packaging unit can be reduced. Furthermore, in the production of (Chinet) disposable tableware the fluorine chemistry can be reduced or even omitted from the manufacturing process. Also, water barrier properties can be improved to reduce the penetration of water into the packaging unit and thereby reducing ridging problems, for example.

Another advantage when using a biodegradable aliphatic polyester in a food packaging unit is the constancy of size or dimensional stability.

As a further advantage of the use of a biodegradable aliphatic polyester, the so-called heat seal ability of the packaging unit is improved. This further improves food packaging characteristics.

An even further advantage of introducing an amount of a biodegradable aliphatic polyester in a food packaging unit is that the properties of the packaging unit can be adjusted by mixing or blending the main biodegradable aliphatic polyester with other polymers or agents. Also, it is possible to prepare the biodegradable aliphatic polyester material for (paper) coating and printing. Furthermore, in some embodiments, digital printing may be applied to the laminated trays to reduce the total cost of the packaging unit. This further improves the sustainability of the packaging unit. Also, a paper look may be achieved.

A further effect that is achieved with the packaging unit according to the invention is the improved insulation. This improves the so-called □ cool-to-touch□ characteristic of the packaging unit. This is beneficial when heating the unit in an oven or microwave, for example. This prevents a consumer from being injured when removing a packaging unit from the oven. More specifically, □ cool-to-touch□ relates to an outside packaging temperature in the range of 10-30° C. after heating the product in an oven, for example. This is a lower temperature as compared to conventional CPET packaging units, for example. Therefore, the packaging unit according to the invention is more safe in use. In addition, the wipe ability (cleaning possibilities in particular for cleaning/wiping the outer surface of the packaging unit) was improved, and more possibilities for masking (hiding) undesirable stains and/or promoting the compostable effect of the packaging unit were achieved.

In one of the presently preferred embodiments of the invention, the amount of biodegradable aliphatic polyester in the food packaging unit is in a range of 0.5-20 wt. %, more preferably in the range of 1-15 wt. %.

By applying an amount of biodegradable aliphatic polyester in one of the aforementioned ranges, the sustainability and packaging characteristics of the food packaging unit according to the present invention is significantly improved.

In a further preferred embodiment of the invention the amount of biodegradable aliphatic polyester is in the range of 2-10 wt. %, preferably in the range of 5-9 wt. %, and most preferably in the range of 6.5-8 wt. %.

Applying an amount of biodegradable aliphatic polyester in these ranges provides packaging units that are both stable and strong. Preferably, the material is sufficiently refined to further enhance the desired characteristics. Especially, applying a refining energy of about 150 kWh/ton material showed a good effect in the mentioned range(s) of biodegradable aliphatic polyester. As a further effect, an overall weight reduction of the packaging unit can be achieved of up to about 20% without affecting the strength and stability of the packaging unit as compared to conventional products, such as CPET or PP trays or the like.

As mentioned earlier, the food packaging unit may comprise one or more further agents in addition to the use of biodegradable aliphatic polyester. This enables a specific design of the food packaging unit characteristics and properties according to customer s specifications or needs taking into account the specific food product.

Preferably, the one or more further agents comprise a biodegradable aliphatic polyester. The use of such biodegradable aliphatic polyester achieves that the food packaging unit maintains its sustainability and recycling properties, while improving specific characteristics of the food packaging unit. For example, the biodegradable aliphatic polyester may comprise an amount of one or more of PBS, PHB, PHA, PCL, PLA, PGA, PHBH and PHBV. Preferably, the use of biodegradable aliphatic polyester is combined with the use of further additives or substances that aim at improving or achieving specific properties of the packaging unit. In further presently preferred embodiments the bio-polymers that are applied originate from so-called non-gmo (non-genetically modified organisms) biopolymers.

For example, it was shown that the use of PLA in addition to another biodegradable aliphatic polyester may improve the strength and stability of the packaging unit, thereby providing a stronger packaging unit and/or requiring less raw material.

According to one of the preferred embodiments of the invention the biodegradable aliphatic polyester comprises an amount of polybutylene succinate (PBS). PBS is one of the biodegradable aliphatic polyesters. PBS can also be referred to as polytetramethylene succinate. PBS decomposes naturally into water, $CO_2$ and biomass. The use of PBS as a compostable material contributes to providing a sustainable product.

The use of PBS is possible in food-contact applications including food packaging units from a moulded pulp material. An advantage of the use of PBS is that the decomposition rate of PBS is much higher as compared to other agents or components such as PLA (including variations thereof such as PLLA, PDLA and PLDLLA, for example).

Therefore, the use of PBS in a food packaging unit from moulded pulp significantly improves the sustainability of the packaging unit. This improves recycling possibilities and biodegrading or decomposing the packaging unit. For example, the use of PBS in lid seals may obviate the need for non compostable PE as inner liner.

Preferably, in one of the embodiments of the invention the packaging unit comprises an amount of micro fibrillated cellulose (MFC) sometimes also referred to as nanofibrillar cellulose or cellulose nanofibers. MFC preferably originates from cellulose raw material of plant origin. The use of MFC enhances the fiber-fiber bond strength and further improves the reinforcement effect. Although MFC is preferably applied in combination with one or more of the biodegradable aliphatic polyesters, it is also possible to use MFC as an alternative to these components.

In an embodiment of the invention the bio-polymers and/or MFC provide a biofilm on or at (a part of) the surface of the packaging unit. Experiments indicate that good barrier properties can be achieved. Alternatively, or in addition thereto, a paper look and/or paper feel surface layer can be provided. For example, a paper layer can be sealed onto a thin layer of (bio)film or a thin layer of biofilm or biopolymer can be coated or laminated onto the paper layer. The biopolymer layer can be sealed onto the surface of a tray or container for food, for example. This paper look and/or paper feel surface layer contributes to the consumer s appreciation of the packaging unit according to such embodiment of the invention. Tests have shown a good wet strength and barrier properties. Barrier properties may include oxygen and/or grease barriers. It is believed that the oxygen barrier properties are achieved by the ability of MFC to form a dense network involving hydrogen bonds.

Optionally, some hydrophobic elements are added to an MFC layer to further improve the water barrier properties. This may involve modification of the hydroxyl groups, for example on the surface of the micro fibrils chemically and/or by absorption of polymers, for example.

A further advantage of the use of MFC is the improved printability, including digital printing possibilities. In addition or as an alternative, MFC may reduce cost by reducing the weight or grammage by increasing the amount of fillers. This may also enhance the optical properties.

It will be understood that combinations of MFC and/or biodegradable aliphatic polyesters may further improve the mentioned effects and advantages. Also, combinations with conventional polymer films, for example by coating MFC and/or a biodegradable aliphatic polyester thereon, may provide a product with the advantages of both types of material.

In one of the preferred embodiments of the invention the food packaging unit is biodegradable. More preferably, the unit is biodegradable at a temperature in the range of 5 to 60° C., preferably in the range of 5-40° C., more preferably in the range of 10-30° C., even more preferably in the range of 15-25° C., and most preferably at a temperature of about 20° C. This renders decomposing of the packaging unit easier. Furthermore, this enables so-called ambient or at home decomposing of the packaging unit according to the invention. For example, the packaging unit according to the invention may be industrial and/or home compostable according to EN 13432.

Optionally, the biodegradable aliphatic polyester, such as PBS, can be manufactured from fossil resources. More preferably, the biodegradable aliphatic polyester, such as PBS, is bio based and made from plant resources, for example. Such bio based biodegradable aliphatic polyester, such as PBS, further improves the sustainability of the food packaging unit.

Optionally, the moulded pulp material can be coloured using additives, dyes (basic dyes, direct dyes, anionic and/or cationic charged dyes), pigments or other components that provide colour to the packaging unit. This enables providing the packaging unit with a colour representative for its (intended) contents.

In a further embodiment of the present invention the packaging unit further comprises an amount of natural and/or alternative fibers.

Providing an amount of natural and/or alternative fibers provides a natural feel to the packaging unit and/or improves the overall strength and stability of the packaging unit. Such natural/alternative fibers may comprise fibers from different origin, specifically biomass fibers from plant origin. This biomass of plant origin may involve plants from the order of Poales including grass, sugar cane, bamboo and cereals including barley and rice. Other examples of biomass of plant origin are plants of the order Solanales including tomato plants of which the leaves and/or stems could be used, for example plants from the Order Arecales including palm oil plants of which leaves could be used, for example plants from the Order Maphighiales including flax, plants from the Order of Rosales including hemp and ramie, plants from the Order of Malvales including cotton, kenaf and jute. Alternatively, or in addition, biomass of plant origin involves so-called herbaceous plants including, besides grass type plants and some of the aforementioned plants, also jute, Musa including banana, Amarantha, hemp, cannabis etcetera. In addition or as an alternative, biomass material origination from peat and/or moss can be applied.

Preferably, the (lignocellulosic) biomass of plant origin comprises biomass originating from plants of the Family of Poaceae (to which is also referred to as Gramineae). This family includes grass type of plants including grass and barley, maize, rice, wheat, oats, rye, reed grass, bamboo, sugar cane (of which residue from the sugar processing can be used that is also referred to as bagasse), maize (corn), sorghum, rape seed, other cereals, etc. Especially the use of so-called nature grass provides good results when manufacturing packaging units such as egg packages. Such nature grass may originate from a natural landscape, for example. This family of plants has shown good manufacturing possibilities in combination with providing a sustainable product to the consumer.

The present invention further relates to a method for manufacturing a food packaging unit from a moulded pulp material, the method comprising the steps of:

preparing moulded pulp material;

adding an amount of biodegradable aliphatic polyester;

moulding the food packaging unit; and releasing the food packaging unit from the mould.

Such method provides the same effects and advantages as described in relation to the food packaging unit. By adding an amount of biodegradable aliphatic polyester to the moulded pulp material, a packaging unit can be manufactured from a blend comprising fibers and biodegradable aliphatic polyester, and/or a separate layer comprising biodegradable aliphatic polyester, can be achieved. This provides a food packaging unit that is more sustainable than conventional packaging units that are moulded for food products. Optionally, other bio-material can be used in combination with the main biodegradable aliphatic polyester, such as PBS, PLA or similar biodegradable components. Such combinations or alternatives may provide similar effects and advantages as described in relation to the packaging unit.

Preferably, the method comprises the step of adding an amount of biodegradable aliphatic polyester in the range of 0.5-20 wt. %, more preferably in the range of 1-15 wt. %. Experiments showed that adding an amount of biodegradable aliphatic polyester in these ranges provides a sustainable food packaging unit with appropriate characteristics.

Preferably, in the moulding step of the food packaging unit, the biodegradable aliphatic polyester connects to the celluloid fibres of the moulded pulp material. This provides a food packaging unit with sufficient strength. In a presently preferred embodiment these connections are achieved by activation of the biodegradable aliphatic polyester. This may involve subjecting the packaging unit to about the melting temperature of the biodegradable aliphatic polyester, for example 145-175° C. More specifically, the biopolymers melt and crosslink/interact with the fibers (cellulose) to increase strength and change properties like barrier properties.

In the life cycle of the packaging unit, in the context of the present invention, the manufacturing process of the food packaging unit preferably also comprises the step of biodegrading the packaging unit. Therefore, in relation to the present invention, preferably also the biodegradation of the packaging unit is considered part of the entire manufacturing process. The biodegradation constitutes a significant part of the life cycle in view of the sustainability.

Preferably, the biodegrading comprises decomposing the food packaging unit.

Even more preferably, the decomposing is performed at a temperature in the range of 5-40° C., preferably in the range of 10-30° C., more preferably in the range of 15-25° C., and most preferably at a temperature of about 20° C., thereby relating to ambient decomposing.

In one of the presently preferred embodiments of the invention the manufacturing method further comprises the step of adding one or more further agents in addition to the main biodegradable aliphatic polyester. The agents preferably comprise a biodegradable aliphatic polyester, preferably comprising an amount of one or more of PBS, PHB, PHA, PCL, PLA, PGA, PHBH and PHBV. This further improves the product characteristics, preferably maintaining the sustainable properties. In presently preferred embodiments the bio-polymers that are applied originate from so-called non-gmo (non-genetically modified organisms) biopolymers.

In a further preferred embodiment of the present invention, the method further comprises the step of in-mould drying the packaging unit. In other embodiments, the method involves rough moulding, like in the moulded fiber egg carton production wherein moulded articles are 3D formed, dried and after-pressed. The in-mould drying further improves the overall manufacturing possibilities. As a further effect, the connection between the biodegradable aliphatic polyester and the fibre material is enhanced.

In a presently preferred embodiment the unit is first moulded in moulds, where after the raw unit is transferred to drying moulds to perform the in-mould drying. After drying the unit is released and a high quality product is achieved with a significantly lower surface roughness as compared to conventional products. Surface roughness can be measured using the Bendtsen measurement process, for example.

In one of the presently preferred embodiments the surface roughness is further reduced by providing an amount of a surface roughness reducing agent, in some of these presently preferred embodiments the agent comprising a biodegradable aliphatic polyester.

Preferably, the manufacturing process comprises the step of refining the moulded pulp material, preferably together with the biodegradable aliphatic polyester. The refining step improves the mixing of the materials and fibrillates the fibers. Refining the fibers may reduce fiber length, fibrillates fibers thereby providing more specific surface of fiber branches that improves binding and H-bridge formation which leads to a stronger, stiffer product. In fact, this improves the number and strength of connections between the moulded pulp material and the biodegradable aliphatic polyester such that the overall strength and stability of the packaging unit is improved. This is even further improved when combining the refining step with the heat treatment step to activate the biodegradable aliphatic polyester.

Further advantages, features and details of the invention are elucidated on the basis of preferred embodiments thereof, wherein reference is made to the accompanying drawings, in which.

Figure 4A:
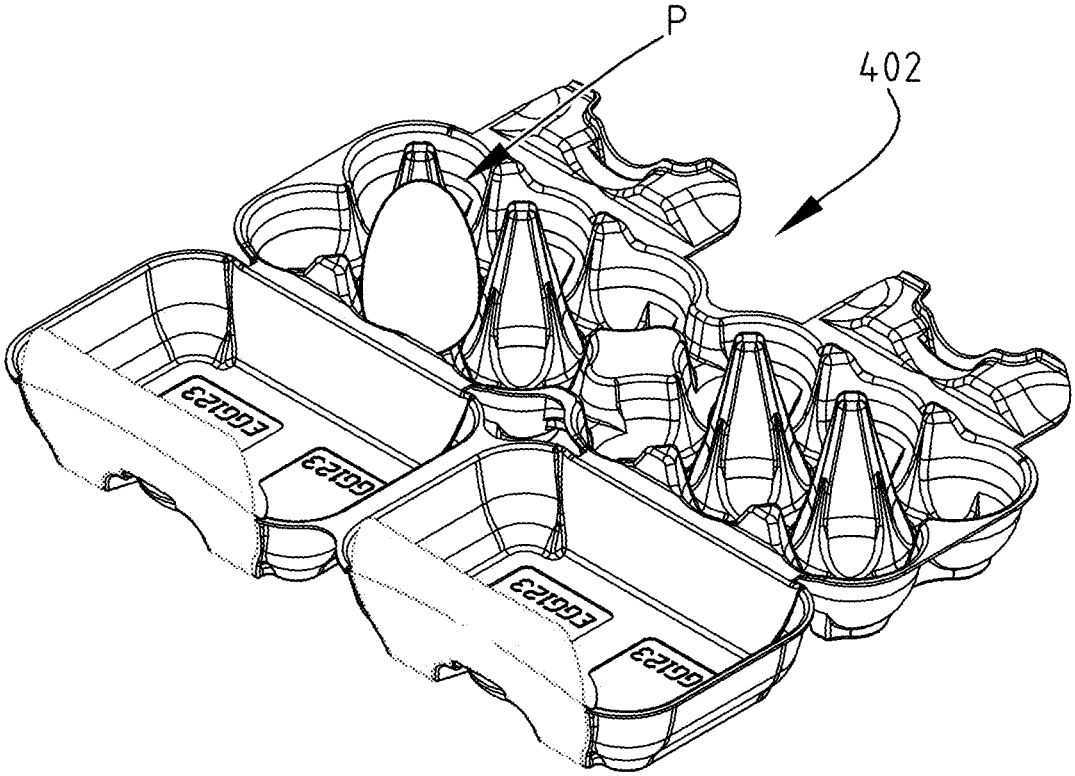
Figure 4B:
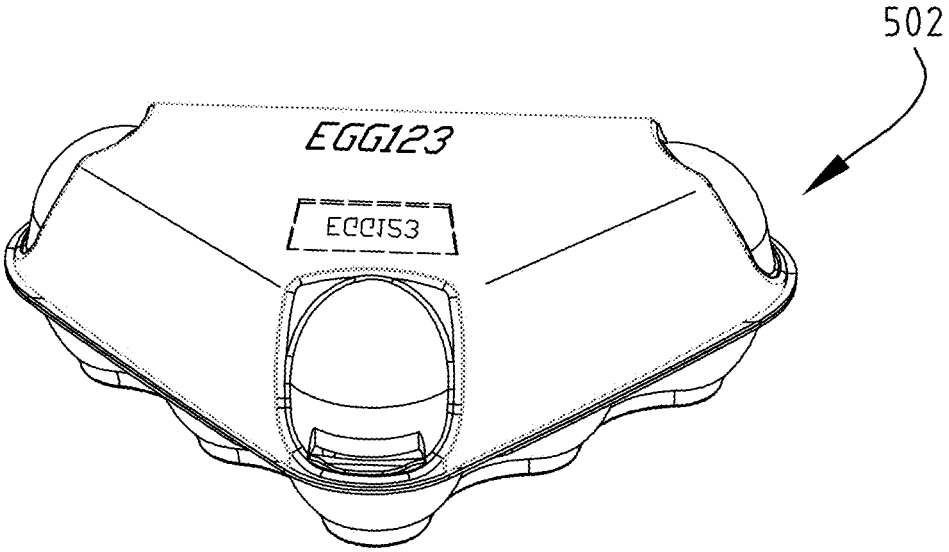
Figure 5:
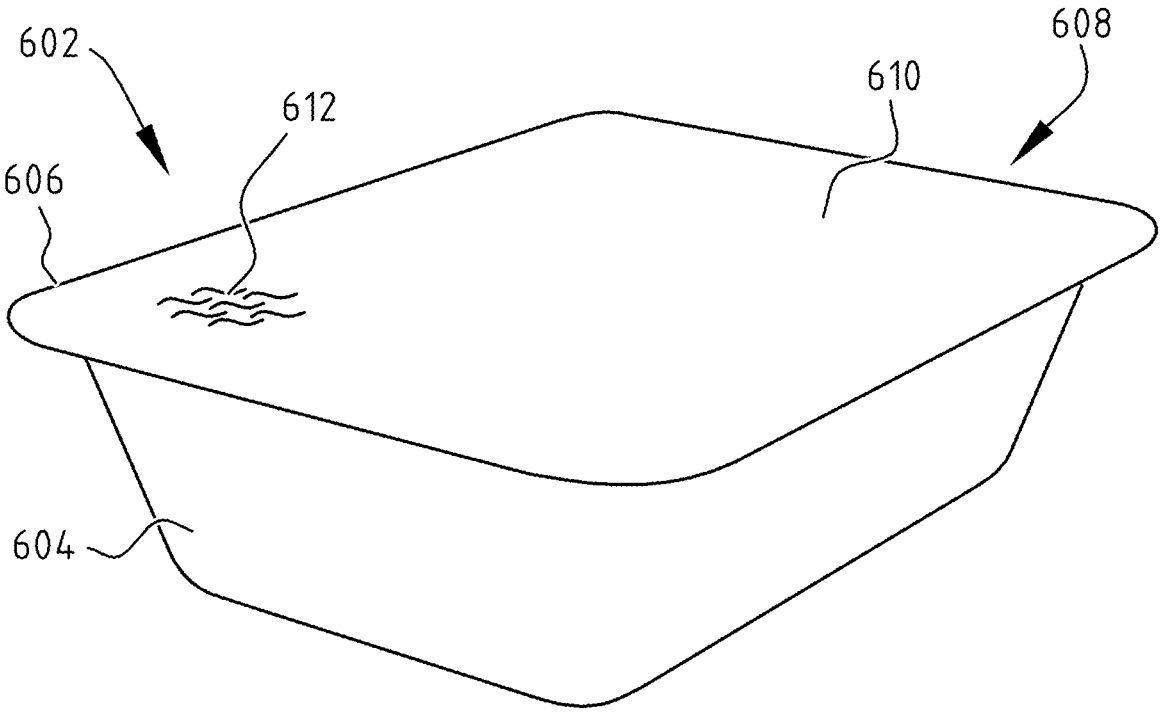

FIGS. 4A and B shows further packaging units for eggs according to the present invention; and FIG. 5 shows a further packaging unit according to the invention for an ice cream product.

Figure 1A:
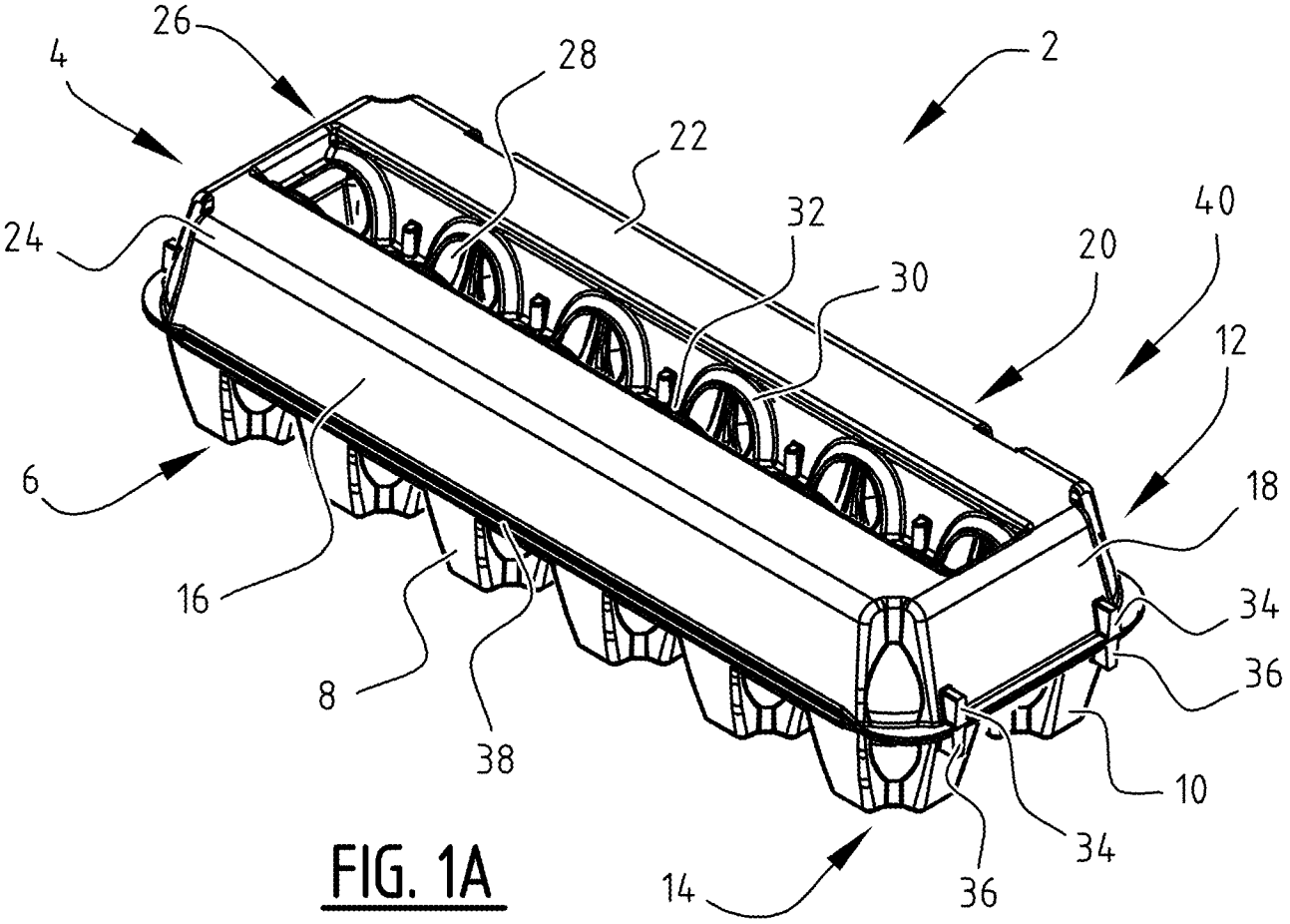
FIGS. 1A and 1B shows a packaging unit according to the invention comprising PBS and/or another biodegradable aliphatic polyester.
Figure 1B:
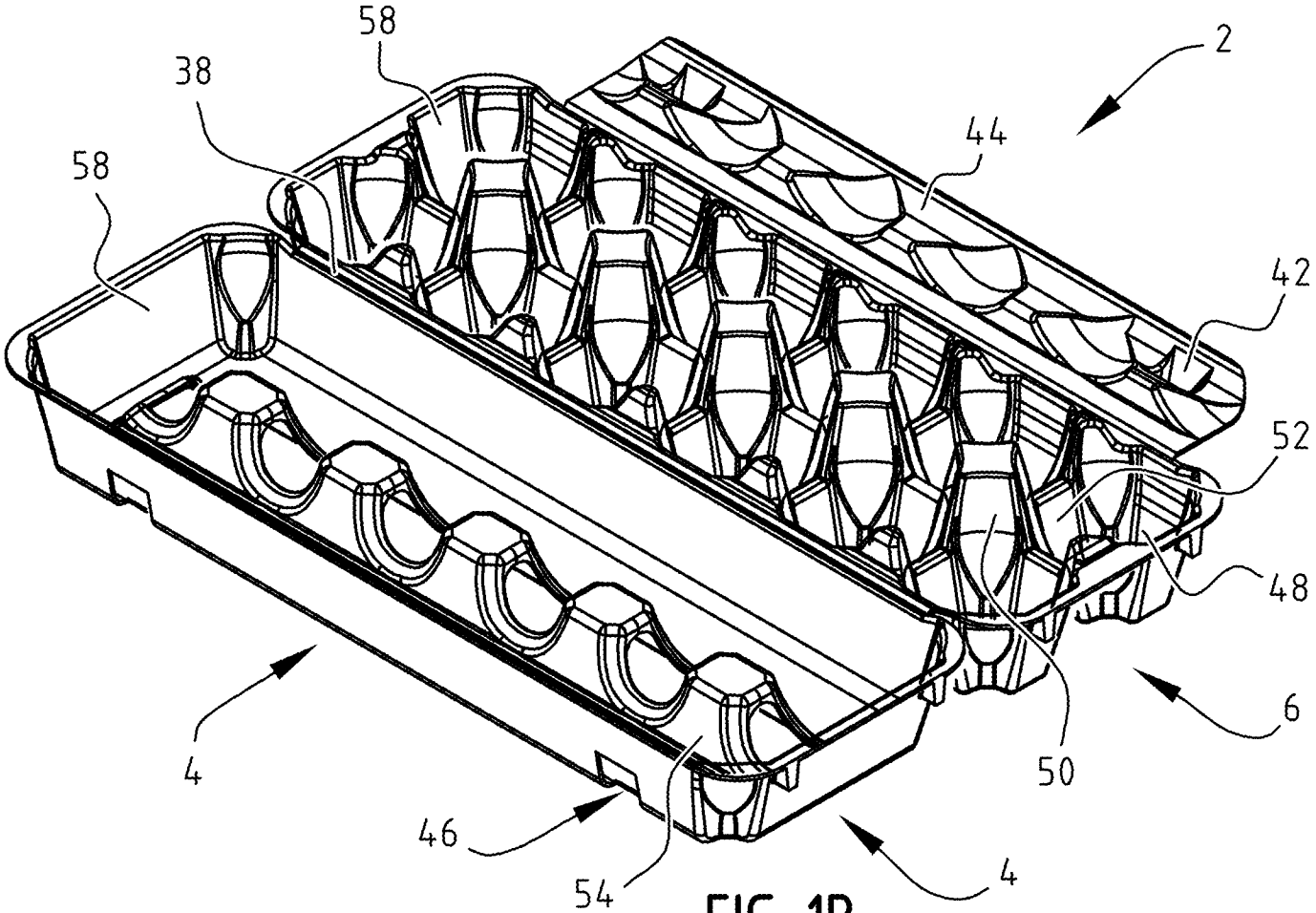

Packaging unit 2 (FIGS. 1A and B) carries or holds eggs and comprises cover part 4 and bottom part 6. Bottom part 6 is provided with back surface 8, sides 10 and front surface 12, and bottom surface 14. Cover part 4 is provided with back surface 16, side surfaces 18, front surface 20 and top surface 22. In the illustrated embodiment transition 24 is provided between top surface 22 and back and front surfaces 16, 20.

In the illustrated embodiment, top surface 22 of cover part 4 is provided with groove 26 comprising a number of openings 28. Openings 28 are defined by two adjacent arch-shaped edges 30, 32 having a larger thickness as compared to the average thickness of cover part 4. Side surfaces 18 of cover part 4 are provided with denest nocks or denest elements 34. In the illustrated embodiment, bottom part 6 is provided with similar elements 36 mirroring denest elements 34. Hinge 38 connects back surface 16 of cover part 4 with back surface 8 of bottom part 6. Lock 40 comprises nose-shaped lock element 42 that is connected to flap 44 of bottom part 6. Cover part 4 is provided with openings 46 that capture lock elements 42 therewith defining lock 40.

In the illustrated embodiment, bottom part 6 is provided with a number of product receiving compartments 48, cones 50 and separating walls 52. Cone 50 extends from the bottom of bottom part 6 in an upward direction. Cover part 4 comprises cone support 54. Inner surface 58 of packaging unit 2 comprises PBS and/or PLA material, optionally as film layer or alternatively blended and/or integrated with the fibres of the moulded pulp material.

In the illustrated embodiment, packaging unit 2 comprises twelve product receiving compartments 48 that are provided in two rows of six compartments 48. Individual compartments 48 are separated from each other by walls 52 and cones 50. It will be understood that other configurations can also be envisage in accordance to the invention.

Packaging unit 2 may also be configured to receive other products, such as tomatoes, kiwis.

Figure 2:
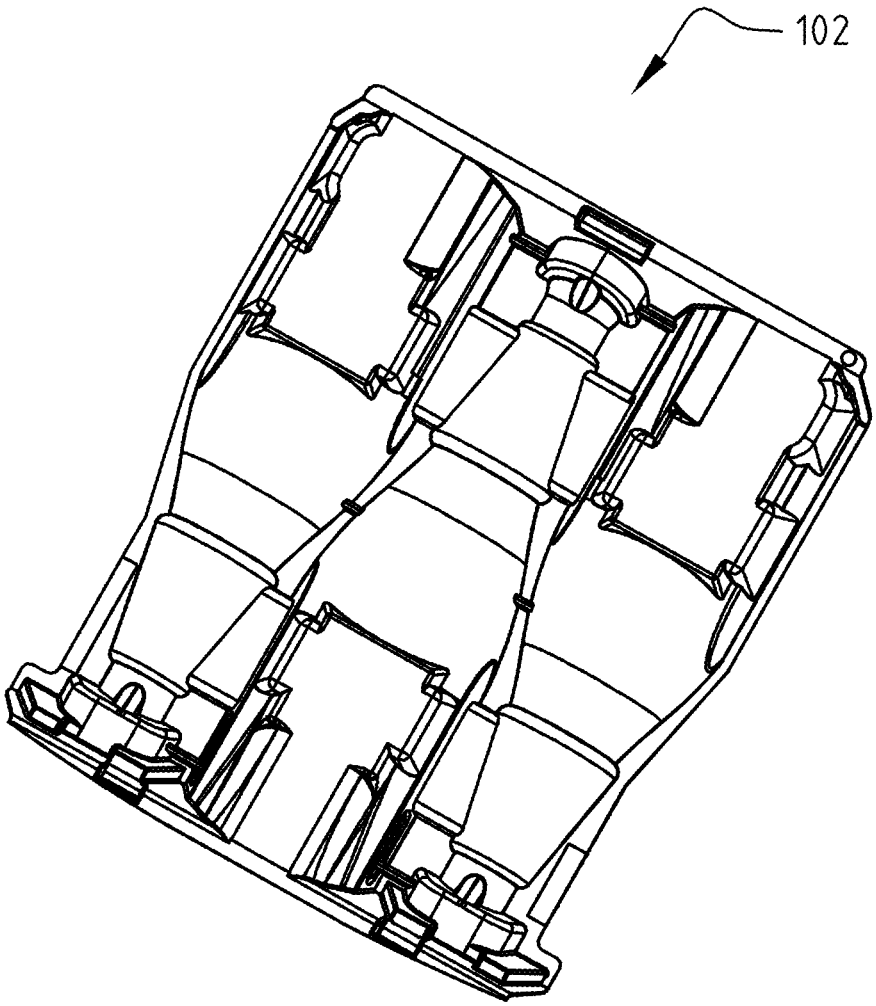
FIG. 2 shows an example of an alternative food packaging product according to the present invention.

It will be understood that other types of food packaging units can also be envisaged in accordance with the present invention. As a further example, bottle divider 101 (FIG. 2) is illustrated. Also, bottle divider 102 may comprise a film layer of PBS (and/or appropriate alternative biodegradable aliphatic polyester) and/or may comprise an amount of PBS that is blended into the moulded pulp.

Figure 3A:
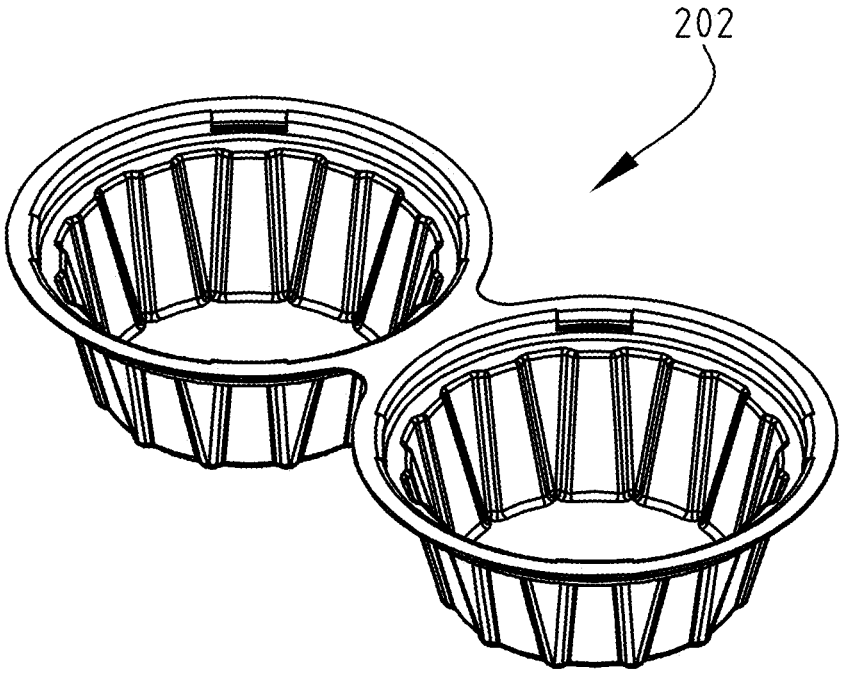
FIGS. 3A and 3B shows an example of a further alternative food packaging product according to the present invention.
Figure 3B:
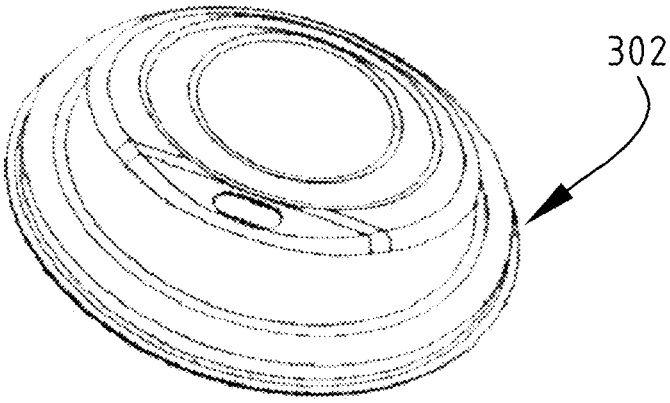

A further example in accordance with the present invention is cover 202, for example for an ice cup. Another example of a packaging unit according to the invention is sip lid 302 (FIG. 3B). Cover 202 and sip lid 302 comprise a film layer of biodegradable aliphatic polyester and/or may comprise an amount of biodegradable aliphatic polyester that is blended into the moulded pulp. This renders cover 202 and sip lid 302 water or liquid repellent. One of the further advantages of the use of biodegradable aliphatic polyester is the reduction or prevention of the liquid entering or migrating into the sip lid material during use. Another advantage is the constancy of size or dimensional stability. In this specific case this prevents sip lid 302 loosening from a cup or beaker for hot beverages such as coffee, tea or soup, or cold beverages such as carbonated drinks, and cup 202 from loosing from an ice cup, for example. It will be understood that such lids 302 can also be applied to other food containers. For example, lids 302 can be applied to containers for milkshakes, for example. Further details and examples of lids 302 are disclosed in WO 2010/064899, including embodiments with specific flanges and notches.

Sip lid 302 is preferably coated with a biodegradable aliphatic polyester liner, such as a PBS liner. As mentioned, sip lids 302 can be used for cups and milkshakes. Also, sip lids can be applied to so-called ready meal trays (for example for pizza, wraps, fish, meat, lobster, pasta, ) and act as a (digital) printable and barrier seal, for example.

It will be understood that other designs for packaging units in accordance with the invention can be envisaged. For example, containers 402, 502 (FIGS. 4A and B) illustrate different designs for egg cartons capable of holding eggs P.

Other examples of food packaging products may relate to cup carriers, cups, plates and other table ware etc.

Packaging unit 602 (FIG. 5) comprises bottom part 604 and cover part 606. Unit 602 is provided with biodegradable aliphatic polyester, such as PBS and/or PLA, and is capable of holding an amount of ice cream. Cover part 606 comprises top seal 608 of a (paper) label whereon layer or film 610 of biodegradable aliphatic polyester(s) is provided. Optionally, fibers 612 are included in the cover part 606. This improves the possibilities for giving the unit a natural paper feel and/or look. This may also be applied to other type of packaging units. For example, in instant or ready-to-eat meals, such that conventional sleeves can be omitted from the packaging units. This enables a more cost-efficient packaging unit with a possible weight reduction.

When manufacturing a food packaging unit 2, 102, 202, 302, 402, 502, 602 a moulded pulp material is prepared. Optionally, an amount of biodegradable aliphatic polyester, such as PBS, is blended or mixed into the moulded pulp material and/or an amount of PBS is included in a separate layer that is provided in or on unit 2, 102, 202, 302, 402, 502, 602. Such separate layer may come into contact with a food product. Next, the raw unit is moulded. Optionally, the raw unit is dried in the mould applying an in-mould drying process. Finally the product is released from the mould. Several post-moulding operations may optionally be performed in relation to unit 2, 102, 202, 302, 402, 502, 602 optionally including, but not limited to, labelling including in-mould labelling, marking including printing and digital printing, testing. In several of the preferred embodiments, the compostable biofilm is at least arranged on the food contact area of the product containing part of the packaging unit. In preferred embodiments this film is capable of being used in a microwave or oven as a so-called ovenable film. Preferably, the biofilm is capable of withstanding temperatures up to 170° C., 190° C., or even higher. This biofilm preferably comprises an amount of PBS and/or MFC and/or biodegradable aliphatic polyester that may comprise an amount of one or more of PHB, PHA, PCL, PLA, PGA, PHBH and PHBV. Especially a combination of a compostable packaging unit involving in-mould drying further improves the sustainability as compared to conventional packaging units. The (digital) printable properties enable printing of packaging and/or food characteristics/information. This may obviate the use of separate sleeves, for example. In addition, it enables the application of prints, for example a fish & chips (newspaper) print on the packaging unit.

Experiments have been performed with one or more of the illustrated food packaging units. These experiments involved comparing the in-use characteristics of the food packaging units as compared to conventional packaging units, and also the compostable characteristics. An amount of a biodegradable aliphatic polyester was added to the moulded pulp material and a refining step was performed. Measurements were done at a temperature of about 23° C. and a relative humidity of about 50%. Measurements involved a compression test. This showed a significant improvement in compression value. For example, a packaging unit with 7.5% PLA and a refining step showed a compression value of 450-500 N, while for a similar conventional product under the same conditions this value is about 180 N. Even a sub-optimal conditions of RH about 90% the compression value for the packaging unit according to the invention was about 250-270 N, thereby still outperforming the conventional product at its optimal conditions.

Other tests were performed to show the dual ovenable (oven and microwave) performance of the packaging unit according to the invention. In the experiments a laminated product with a film of a biodegradable aliphatic polyester (PBS/PLA and/or PHBH) was heated to a temperature of about 190° C. for about 30 minutes. Results show that the film layer remains intact and does not melt. Furthermore, the strength and stability of the packaging unit were not significantly affected. As a further effect, the packaging unit was more stable in view of twisting when removing the packaging unit from the oven as is often the case with conventional packaging units. Furthermore, the packaging unit of the invention showed a limited temperature increase to about 50-70° C., while the conventional units reached a temperature of about 90-100° C. under similar conditions. Other experiments with a PHBH film that is laminated on the inside of a (food) tray shows an even improved heat resistance when heating the tray to a temperature of 180-200° C., and in addition shows (an improved) oil, acid and moisture resistance/repellence.

In still further tests other characteristics were examined. It was shown that wipeability of the packaging unit could be improved. Further improvements where shown by addition of further additives.

The present invention is by no means limited to the above described preferred embodiments thereof. The rights sought are defined by the following claims, within the scope of which many modifications can be envisaged.

The invention claimed is:

1. A food packaging unit from a moulded pulp material, the packaging unit comprising a food receiving or carrying compartment, wherein the moulded pulp material comprises a mixture of a moulded pulp and a biodegradable aliphatic polyester, wherein the food packaging unit is a compostable food packaging unit and wherein the amount of biodegradable aliphatic polyester is in the range of 0.5 to 20 wt. %.

2. The food packaging unit according to claim 1, wherein the amount of biodegradable aliphatic polyester is in the range of 2-10 wt. %.

3. The food packaging unit according to claim 1, further comprising one or more further agents from a biodegradable aliphatic polyester.

4. The food packaging unit according to claim 1 wherein the biodegradable aliphatic polyester comprises an amount of one or more of PBS, PHB, PHA, PCL, PLA, PGA, PHBH and PHBV.

5. The food packaging unit according to claim 1, wherein the unit biodegrades at a temperature in the range of 5 to 60° C.

6. The food packaging unit according to claim 1, wherein the biodegradable aliphatic polyester is bio based.

7. The food packaging unit according to claim 1, further comprising an amount of natural and/or alternative fibers.

8. A food packaging unit from a moulded pulp material, the packaging unit comprising a food receiving or carrying compartment, wherein the moulded pulp material comprises a mixture of a biodegradable aliphatic polyester and a moulded pulp, wherein the food packaging unit is a compostable food packaging unit, wherein the amount of biodegradable aliphatic polyester is in the range of 0.5-20 wt. %, wherein the biodegradable aliphatic polyester comprises an amount of one or more of PBS, PHB, PHA, PCL, PLA, PGA, PHBH and PHBV.

* * * * *